United States Patent [19]

Niggemann

[11] Patent Number: 4,993,487

[45] Date of Patent: Feb. 19, 1991

[54] SPIRAL HEAT EXCHANGER

[75] Inventor: Richard E. Niggemann, Rockford, Ill.

[73] Assignee: Sundstrand Corporation, Rockford, Ill.

[21] Appl. No.: 330,071

[22] Filed: Mar. 29, 1989

[51] Int. Cl.[5] ..... F28D 9/04

[52] U.S. Cl. ..... 165/164; 165/163

[58] Field of Search ..... 165/163, 164

[56] References Cited

U.S. PATENT DOCUMENTS

| | | | |
|---|---|---|---|
| 104,180 | 6/1870 | McMillan | 165/164 |
| 1,930,879 | 10/1933 | Linderoth et al. | 165/166 X |
| 2,131,265 | 9/1938 | Bichowsky | 113/118 |
| 2,236,976 | 4/1941 | Rosenblad | 165/166 X |
| 3,762,467 | 10/1973 | Poon et al. | 165/163 |
| 3,921,713 | 11/1975 | Schnitzer et al. | 165/167 |
| 4,124,069 | 11/1978 | Becker | 165/164 |
| 4,200,734 | 4/1980 | Muehlenbrock et al. | 528/503 |
| 4,445,569 | 5/1984 | Saho et al. | 168/165 |
| 4,494,171 | 1/1985 | Bland et al. | 361/386 |
| 4,516,632 | 5/1985 | Swift et al. | 165/167 |
| 4,546,826 | 10/1985 | Sitzmann | 165/163 |
| 4,697,427 | 10/1987 | Niggemann et al. | 62/119 |
| 4,729,428 | 3/1988 | Yasutake et al. | 165/166 |
| 4,785,878 | 11/1988 | Honkajärvi et al. | 165/163 |

FOREIGN PATENT DOCUMENTS

| | | | |
|---|---|---|---|
| 155009 | 6/1938 | Austria | 165/164 |
| 668493 | 12/1938 | Fed. Rep. of Germany | 165/164 |
| 1396469 | 3/1965 | France | 165/164 |
| 23517 | of 1914 | United Kingdom | 165/164 |

*Primary Examiner*—Martin P. Schwadron
*Assistant Examiner*—Allen J. Flanigan
*Attorney, Agent, or Firm*—Antonelli, Terry, Stout & Kraus

[57] ABSTRACT

A laminated spiral heat exchanger (10) in accordance with the invention includes a heat conductive top laminate (30); a heat conductive bottom laminate (36), at least one spiral heat conductive laminate (42), the laminates being joined together to form a heat exchanger core; at least one spiral channel (18) disposed within at least one spiral laminate; a first fluid port (20) coupled to each spiral channel at a first radius with respect to a center of the spiral heat exchanger; and a second fluid port (24) coupled to each spiral channel at a second radius with respect to the center point of the spiral heat exchanger which is greater than the first radius.

41 Claims, 7 Drawing Sheets

SPIRAL HEAT EXCHANGER

DESCRIPTION

1. Technical Field

The present invention relates to heat exchangers having first and second spaced apart channels respectively conducting a coolant fluid and a heated fluid in which at least one of the channels is a spiral. More particularly, the present invention relates to heat exchangers of the aforementioned type having high performance, which are lightweight and are readily fabricated without costly fabrication processes.

2. Background Art

U.S. Pat. No. 4,696,427, which is assigned to the assignee of the present invention discloses a spiral evaporator for use in cooling heat loads such as electronic components. The '427 patent discloses that the evaporator achieves high efficiency of heat transfer by forcing a two-phase coolant through a spiral-shaped channel at high velocity. The outward spiral flow causes the walls of the spiral channel to be effectively wetted with the coolant to provide high efficiency heat transfer even under unusual gravitational conditions such as those present in high performance aircraft. Complete wetting of the walls of the spiral channel with the liquid phase of the coolant is caused by centrifugal force leading to secondary flows within the channel.

The evaporator of the '427 patent does not exchange heat between parallel spiral channels from a heated fluid to a coolant. Furthermore, the spiral channel does not contain structures which provide enhanced heat transfer. Finally, '427 patent does not disclose that the coolant becomes superheated and does not disclose any structures within the channel of the evaporator for enhancing heat transfer for portions of the channel containing superheated coolant.

Fabrication of an evaporator in accordance with the '427 patent involves complicated machining and fabrication steps. Furthermore, incorporation of high performance enhanced surface area cooling structures within the spiral channel would be difficult with the unitary spiral channel disclosed in the '427 patent.

Jet impingement heat exchangers have been developed which utilize an impingement cooling principle for exchanging heat between different fluids flowing through the heat exchanger. Some heat exchangers that use the jet impingement cooling principle are of the impingement plate type. With the impingement plate type of heat exchanger, fluid flowing in a channel &through a heat exchanger core passes through a plurality of orifices in a plate disposed across the channel to create fluid jets which strike a solid portion of a subsequent plate in the channel where the impinging fluid moves along the subsequent plate to the nearest orifice and passes through the subsequent plate for impingement against a next plate and so on. The orifices in adjacent plates are intentionally misaligned so that the fluid must impinge directly on a subsequent plate prior to passing through the orifices located therein. This misalignment forces the fluid to impinge against each plate after passing through the previous plate to provide a tortuous path for the fluid rather than permitting the fluid merely to flow through holes in the stack of plates. Eventually, after passing through a series of plates, the fluid leaves the heat exchanger. The jet impingement cooling principle substantially increases the rate of heat transfer between the fluid and each plate. The orifices may be circular or rectangular.

U.S. Pat. No. 4,494,171, which is assigned to the assignee of the present invention, discloses a jet impingement type of heat exchanger. A source of coolant fluid is directed through a series of laminated plates which are adjoined together to form channels for conducting the cooling fluid to a device to be cooled such as a mirror in a high energy laser. Alternating plates of the stack of plates contain a series of orifices each passing through the plate to create jets of cooling fluid which strike each subsequent plate. After the coolant fluid strikes a surface of the device to be cooled, it is directed back to the coolant source in a direction parallel to and opposite to the direction which the fluid flowed toward the device to be cooled.

U. S. Pat. No. 4,516,632 discloses a heat exchanger core in the form of a polyhedron which is fabricated by stacking thin metal sheets together to form the heat exchanger core. A series of plates 14 and 16 respectively with elongated slots 14A and 16A are alternated in the stack of plates and separated by unslotted plates 12. The orientations of the plates 14 and 16 are rotated 90° with respect to the longitudinal axis of the slots therein such that ends of the slots overhang the slots of the adjacent plates.

U. S. Pat. No. 4,729,428 discloses a plate fin type heat exchanger. Structures are disclosed for use in the channels to increase the rate of heat transfer in the channels.

Furthermore, structures have been developed for plate-type heat exchangers to modify the heat exchanger characteristics. It is known to provide passages between adjacent channels in which fluid is flowing through a heat exchanger core to provide a new boundary layer to enhance the heat exchange between the fluid and the surfaces of the heat conductive channel. Furthermore, it is known to provide perforations within the side walls of a channel in which fluid is flowing through a heat exchanger core to increase the turbulence of fluid flowing in the channel of the heat exchanger.

U.S. Pat. Nos. 104,180, 2,131,265, 3,762,467 and 4,546,826 disclose spiral heat exchangers. The heat exchangers disclosed in these patents are not concerned with achieving high performance lightweight cores which are economical to fabricate.

DISCLOSURE OF THE INVENTION

The present invention provides a spiral heat exchanger for transferring heat between a fluid flowing in a spiral channel and a heat exchanger core. Furthermore, the invention provides a spiral heat exchanger for transferring heat between a heated fluid flowing in a second spiral channel to a coolant fluid flowing in a first adjacent spiral channel. Moreover, the invention provides a spiral heat exchanger for exchanging heat between a heated fluid flowing between top and bottom surfaces of the heat exchanger and a coolant flowing transverse to the direction of the heated fluid in a spiral channel within the heat exchanger. Applications of the heat exchanger in accordance with the present invention include evaporators and condensers. A heat exchanger in accordance with the invention is especially suitable as an evaporator to be used for cooling avionics and cockpit air of high performance aircraft subject to high g acceleration. The heat exchanger results in a high coefficient of performance when utilized as an evaporator of a vapor cycle cooling device. The high coefficient of performance is achieved with the cross-sectional area of the first channel, in which the coolant flows, increasing as a function of radius of the first channel to minimize the pressure drop in the first channel. Additionally, structures having increased surface area may be disposed within a second portion of the first channel where the coolant is superheated and in the second channel to respectively enhance the rate of heat transfer to the coolant flowing within the second portion of the first channel from the heat conductive surfaces of the heat exchanger core and from the heated fluid in the second channel to the heat conductive surfaces of the heat exchanger core.

The second channel may contain structures having increased surface area and/or creating new boundary layers or increased turbulence. Additionally, the second channel may contain structures for minimizing the buildup of ice in the second channel which could occlude the flow of the heated fluid in the second channel. The structures for minimizing the buildup of ice in the second channel are preferably in the form of pockets at spaced apart locations in the walls of the second channel which project toward the first channel for trapping ice within the pockets out of the main flow of the heated fluid within the first channel. These trapped packets will tend to hold any thin layer of ice in the channel tightly to the wall.

Furthermore, the present invention utilizes laminates in the fabrication of the first and second spiral channels of the heat exchanger core. The laminates permit the fabrication of a heat exchanger core with spaced apart spiral channels which incorporate therein high performance heat transfer structures having increased surface area to enhance the transfer of heat from the heat source fluid to the coolant. Furthermore, the individual laminates may be fabricated by using conventional metal working processes such as stamping, punching or drilling. Moreover, channels are formed within the spiral shaped laminates to form fluid flow channels for the heat carrying fluid in the second channel and for the coolant in the second portion of the first channel by chemical processes such as photoetching. Additionally, holes may be formed in the channels within the spiral laminates to provide fluid flow paths transverse to the thickness of the laminates to produce the new boundary layers and/or increased turbulence within the second channel carrying the heated fluid and further within the second portion of the first channel carrying the coolant fluid which is superheated.

Moreover, the present invention utilizes laminates in the fabrication of a spiral heat exchanger for exchanging heat between a heated fluid flowing between top and bottom surfaces within a plurality of connecting heat conductive channels and a coolant flowing in a spiral channel within the heat exchanger. The laminates may be formed with jet impingement cooling structures within the connecting channels.

A laminated spiral heat exchanger in accordance with the invention includes a heat conductive top laminate; a heat conductive bottom laminate; at least one spiral heat conductive laminate, the laminates being joined together to form a heat exchanger core; at least one spiral laminate with at least a portion of a first spiral channel being defined by a space extending through a thickness of the spiral laminate between adjacent turns of at least one spiral laminate and the top laminate and the bottom laminate; a first fluid port coupled to each spiral channel at a first radius with respect to a center of the spiral heat exchanger; a second fluid port coupled to each spiral channel at a second radius with respect to the center point of the spiral heat exchanger which is greater than the first radius. Preferably, the heat exchanger core includes a second spiral shaped spaced from the first channel defined by a plurality of laminates, the second spiral channel having a third fluid port located at a third radius located with respect to the center point of the heat exchanger and a fourth fluid port located a fourth radius located with respect to the center point of the heat exchanger with the fourth radius being greater than the third radius. The space between adjacent turns varies as a function of a radius of the first channel measured from the center point. The first fluid is a coolant and is coupled to the first channel from a first fluid source at the first port with the first fluid flowing through the first channel to the second port; the second fluid is a heated fluid and is coupled to the second channel from a second fluid source at the third port with the second fluid flowing through the second channel to the fourth port; and the first channel has a cross sectional area which increases as a function of increasing radius of the first channel with respect to the center of the spiral heat exchanger along at least a first portion of the first channel extending from the first port and providing liquid contact with walls of the first channel when the first fluid is in a liquid phase.

The coolant flow through the first channel in the first portion of the first channel is at least partially in a liquid state and the coolant flow in the second portion of the first channel is superheated and the first portion of the first channel has a first heat exchange surface area per unit length and the second portion of the first channel has a second heat exchange surface area per unit length which is greater than the first heat exchange surface area. The first channel may be part of a vapor cycle cooling device. The sidewalls of the first portion of the first channel are defined by a space between adjacent turns of at least one spiral laminate and top and bottom walls of the first channel are defined by the top and bottom laminates; and the second spiral channel is defined by at least one cutout channel extending into a surface of at least one spiral laminate parallel to the top and bottom laminates and extending from the third port to the fourth port. Preferably, the second spiral channel is defined by at least one first cutout channel in each of the plurality of spiral laminates, each cutout channel extending into a surface of a spiral laminate parallel to the top and bottom laminates on a pair of opposed sides of the first spiral channel and extending from the third port to the fourth port. The second channel may contain a structure for permitting the second fluid to flow between different spiral laminates as the second fluid flows through the second channel. The structure for permitting comprises each spiral laminate containing a series of holes extending through the spiral laminate with each hole having an opening within the first cutout channel; and the plurality of spiral laminates are in registration with the first cutout channel of each spiral laminate being at least partially in registration with at least one adjacent first cutout channel of an adjacent spiral laminate and the holes of adjacent spiral laminates are offset so that the second fluid does not flow orthogonally with respect to the top and bottom laminates through cutout channels of adjacent spiral laminates. The holes may be disposed in a single row along the first cutout channel, adjacent holes being separated by a solid portion spanning the first cutout channel in a direction along fluid flow in the second channel. Alternatively, the holes may be disposed in a plurality of arrays disposed at spaced apart locations along fluid flow in the second channel with each array being separated by a solid portion spanning the first cutout channel in a direction along fluid flow in the second channel.

The second portion of the first channel may contain structure for permitting the first fluid to flow between different spiral laminates as the first fluid flows through the second portion of the first channel. The second portion of the first channel is defined by a second cutout channel extending partially within a plurality of spiral laminate parallel to the top and bottom laminates and extending along the second portion to the second port; each spiral laminate containing a series of holes extending through the spiral laminate with each hole having an opening within the second cutout channel in the second portion of the first channel; and the second cutout channel of each spiral laminate is in at least partial registration with at least one adjacent second cutout channel of an adjacent spiral laminate and the holes of adjacent spiral laminates are offset so that fluid does not flow orthogonally with respect to the top and bottom laminates through the second cutout channels of adjacent spiral laminates. The holes may be disposed in a single row along the second cutout channel with adjacent holes being separated by a solid portion spanning the second cutout channel in a direction along fluid flow in the first channel. Alternatively, the holes may be disposed in a plurality of arrays disposed at spaced apart locations along fluid flow in the first channel with each array being separated by a solid portion spanning the second cutout channel in a direction along fluid flow in the second channel.

The second channel may include a mechanism for accommodating ice formation within the second channel to prevent occlusion of the second channel to the flow of the heated fluid. The mechanism for grounding a thin ice layer comprises a series of pockets contained in sidewalls of the second channel which project from at least one of the sidewalls toward an adjacent first channel. This physically locks the ice layer to the side wall.

A spiral heat exchanger in accordance with the invention includes a heat exchanger core containing first and second spaced apart spiral channels within the core; the first spiral channel having a coolant inlet port located at a first radius with respect to a center point of the heat exchanger and a coolant outlet port located at a second radius with respect to the center point of the heat exchanger which is greater than the first radius, the second spiral channel having a heated fluid inlet port located a third radius with respect to the center point of the heat exchanger and a heated fluid outlet port located at a fourth radius with respect to the center point of the heat exchanger which is greater than the third radius, a source of pressurized coolant fluid coupled to the first fluid inlet port and a condenser coupled to the first fluid outlet port and heat flows from the heated fluid to the heat exchanger core to the coolant; and wherein the first spiral channel has an increasing cross-sectional area from the coolant inlet port toward the coolant outlet port as a function of a radius of the first spiral channel extending from the center point of the heat exchanger extending to the first spiral channel, and the coolant in a liquid phase wets sidewalls of the first channel during flow of the coolant from the coolant fluid inlet port toward the coolant fluid outlet port. The first spiral channel has a first portion extending from the coolant inlet port toward the coolant outlet port to a point where the coolant becomes superheated and a second portion extending from the point where the coolant becomes superheated to the coolant outlet port. The second portion of the first channel and the second channel contain a plurality of heat conductive surfaces disposed within an interior of the channel and in thermal contact with the heat exchanger core to enhance transfer of heat between the heated fluid and the coolant by causing the superheated coolant in the second portion of the first spiral channel to flow transversely with respect to a spiral axis of the first channel and the heated fluid to flow transversely with respect to a spiral axis of the second spiral channel. The second portion of the first channel has structures for causing transverse coolant fluid flow with respect to a spiral axis of the first channel and the first channel contains structures for causing transverse heated fluid flow with respect to a spiral axis of the second channel. Structures are disposed within the second channel for accommodating ice formation within the second channel to prevent occlusion of the second channel to the flow of heated fluid therein. Preferably, the structures for accommodating ice formation comprise a series of pockets contained in sidewalls of the second channel which project from at least one sidewall toward an adjacent first channel.

A laminated spiral heat exchanger in accordance with the invention includes a heat conductive top laminate; a heat conductive bottom laminate; a plurality of spiral heat conductive laminates, the laminates being joined together to form a heat exchanger core; a spiral channel disposed between turns of at least one spiral laminate; a first fluid port coupled to the spiral channel at a first radius with respect to a center of the spiral heat exchanger; a second fluid port coupled to the spiral channel at a second radius with respect to the center point of the spiral heat exchanger which is greater than the first radius; a plurality of connecting heat conductive channels disposed between the top laminate and the bottom laminate for connecting apertures in the top and bottom laminates, a plurality of the heat conductive connecting channels each containing a jet impingement cooling mechanism therein for forming at least one jet when a fluid flows between the top and bottom laminates which intersects a heat conductive surface within the connecting channel to provide enhanced heat exchange between the connecting channel and the second fluid. A plurality of alternating first and second spiral laminates are contained in the heat exchanger to form the first spiral channel, each of the first spiral laminates and each of the second spiral laminates containing a cut out channel section having first and second ends and which extends radially with respect to the center of the spiral heat exchanger, the first end of each cut out channel section of the first spiral laminate having an aperture extending through the cut out channel section to an opposed side of the first spiral laminate and the second end of cut out channel section of the second spiral laminate having an aperture extending through the second channel section to an opposed side of the second spiral laminate, the opposed side of the apertures of the first spiral laminates each opening into an underlying cut out channel section of one of the second spiral laminates and the opposed side of the apertures of the second spiral laminates each opening into an underlying cut out channel section of one of the first spiral laminates. A connecting heat conductive channel is disposed adjacent to each opening between adjacent turns of a plurality of spiral laminates. The first fluid is a coolant and the second fluid is a heated fluid which may be air.

BEST MODE FOR CARRYING OUT THE INVENTION

Figure 1:
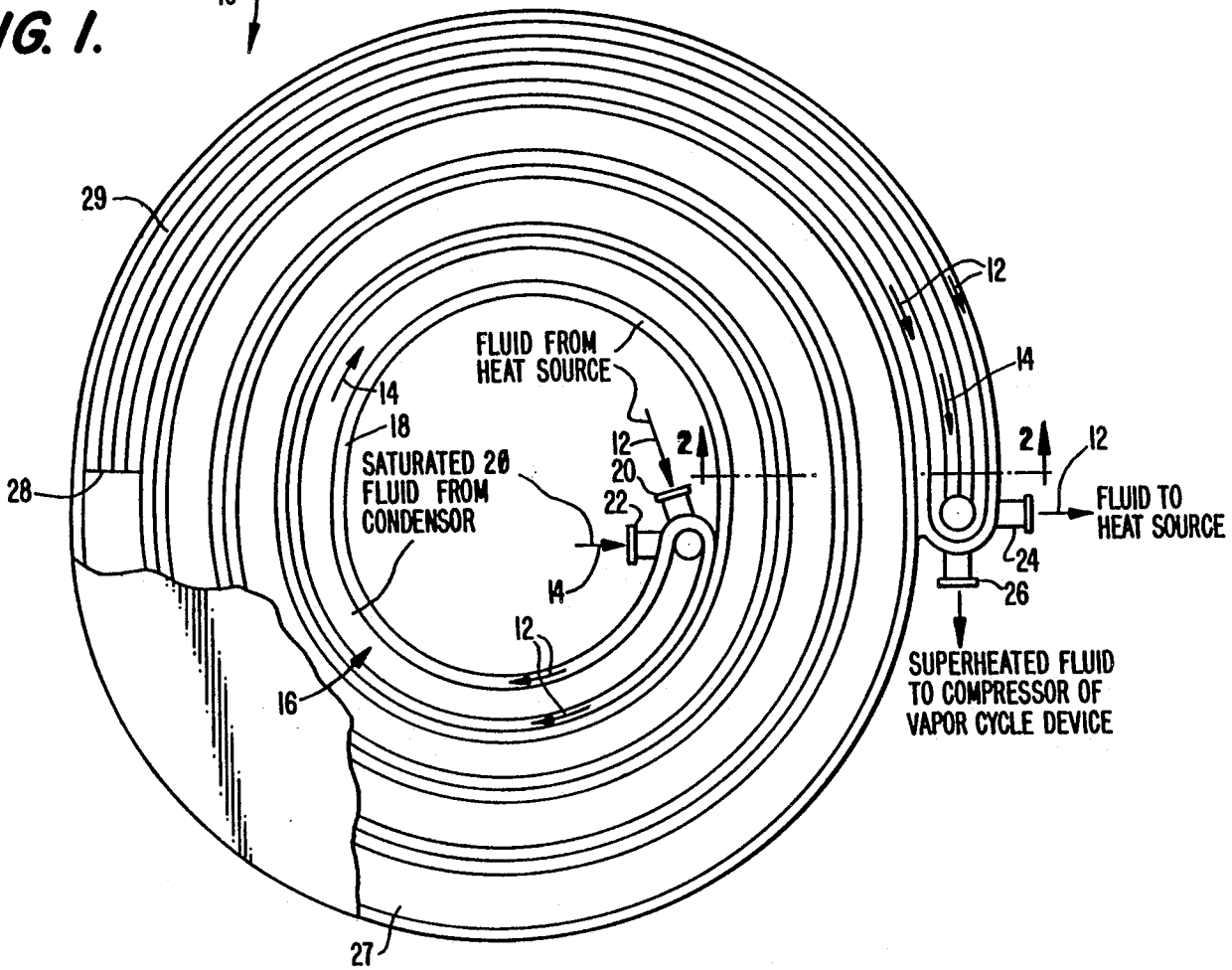
FIG. 1 illustrates a fragmentary top plan view of a spiral heat exchanger in accordance with a first embodiment of the present invention.

FIG. 1 illustrates a top plan view of a spiral heat exchanger 10 in accordance with the present invention. It should be understood that the heat exchanger 10 has diverse applications including usage in evaporators and condensers of vapor cooling systems. Furthermore, the present invention is especially adapted for utilization in evaporators and condensers in airframes as a consequence of its lightweight and suitability for operation under high g conditions such as those encountered in high performance aircraft. As an evaporator, the heat exchanger of the present invention may be utilized for cooling of avionics and cockpit air. The heat exchanger 10 functions to exchange heat between a heated fluid 12 provided from a heat source, such as the aforementioned avionics and cockpit air (not illustrated), and a coolant 14 which may be a saturated two-phase fluid, such as Freon, which has been discharged from a condenser of a vapor cooling device.

The heat exchanger 10 has first and second spaced apart spiral channels 16 and 18 which respectively conduct the coolant 14 and the heated fluid 12. The heated fluid 12 and the coolant 14 are respectively applied to inlets 20 and 22 at first and second radii with respect to the center point of the heat exchanger. The heated fluid and the coolant fluid are respectively discharged at outlets 24 and 26 at third and fourth radii with respect to the center point of the heat exchanger. The first and second radial radii are substantially equal; and the third and fourth radii are substantially equal with the third and fourth radii being greater than the first and second radii. The channels 16 and 18 each have a channel radius with respect to the center of the heat exchanger which increases along the longitudinal dimension of the channel extending from the inlet to the outlet. The heat exchanger core 10 is fabricated from a plurality of stacked laminates which are sealed together to form the coolant channel 16 and the heated fluid channel 18 as described below with reference to FIGS. 2-5. The heated fluid 12 and the coolant 14 respectively flow radially outward in the channels 18 and 16 with it being understood that the direction of flow of the heated fluid may be reversed depending upon coolant selection and application. As a consequence of the pressure head respectively applied to these fluids at the inlets 20 and 22, substantial velocity is imparted to the fluids which causes their centrifugal acceleration as they flow outward to produce wet wall contact with the walls of the heat exchanger core defining the heated fluid channel 18 and the coolant channel 16. As a consequence of wet wall contact, the rate of heat transfer between the fluids through the heat conductive heat exchanger core 10 is substantially enhanced over that which would be achieved without wet wall contact. The flow patterns within the cross section of the coolant channel 16 and the heated fluid channel 18 are similar to those described in U.S. Pat. No. 4,697,427 referred to above. As the coolant 14 flows radially outward within channel 16, it changes phase from being a saturated two-phase state to a gaseous phase. The transformation point 28 at which the coolant 14 becomes superheated would typically occur within the outermost turn of the coolant channel 16. The first portion 27 in channel 16 is defined by four walls 39 formed by the laminates as described below in FIG. 3. In order to minimize the overall weight of the heat exchanger 10 while promoting maximum heat transfer, the portion 29 in the channel 16 from point 28 to the outlet 26 where the coolant is superheated is provided with structures having increased surface area such as, but not limited to, those illustrated to FIGS. 2, 4A-B and 5A-B. These structures provide new boundary layers and/or increased turbulence. The structures having increased surface area per unit length in the portion 29 of the coolant channel 16 are necessary to maintain a high rate of heat transfer between the heated fluid 12 in channel 18 and the coolant 14 from the point 28 to the outlet 26 of the coolant channel. Without a structure within the second portion 29 of the channel 16 from point 28 to the outlet 26 having increased surface area, the overall rate of heat transfer would decrease substantially as a consequence of wet wall contact with the coolant channel walls no longer being present which would drop the rate of heat transfer between one and two orders of magnitude between the walls of the heat exchanger core in the second portion and the superheated coolant. Placement of structures having increased surface area and which may provide new boundary layers and/or increased turbulence in the second portion 29 of the channel 16 beginning at point 28 where the coolant becomes superheated minimizes the weight of the heat exchanger core by providing these structures only in the area where the superheating occurs where increased surface area is necessary for efficient heat transfer. Similarly, in order to minimize the overall weight of the heat exchanger 10 while promoting maximum heat transfer, the heated fluid channel 18 is provided with structures having increased surface per unit length such as, but not limited to, those illustrated in FIGS. 2, 4A-B and 5A-B. These structures may provide new boundary layers and/or increased turbulence.

The heat exchanger of the present invention has been designed to achieve a high coefficient of performance when utilized in a vapor cycle cooling device. The cross-sectional area of the coolant channel 16 increases as a function of increasing radius of the channel with respect to the center of the heat exchanger 10 to minimize the pressure drop within the channel as the coolant flows radially outward from the inlet 22 to the outlet 26. Without the aforementioned increase in cross-sectional area of the coolant channel 16 as a function of radius of the coolant channel, pressure drop would be increased which would lower the coefficient of performance. Having a high coefficient of performance is particularly important on airframes where achieving maximum cooling for energy expended is extremely important as a consequence of any lowered efficiency representing a weight penalty in the airframe requiring additional weight to produce the requisite cooling performance.

Figure 2:
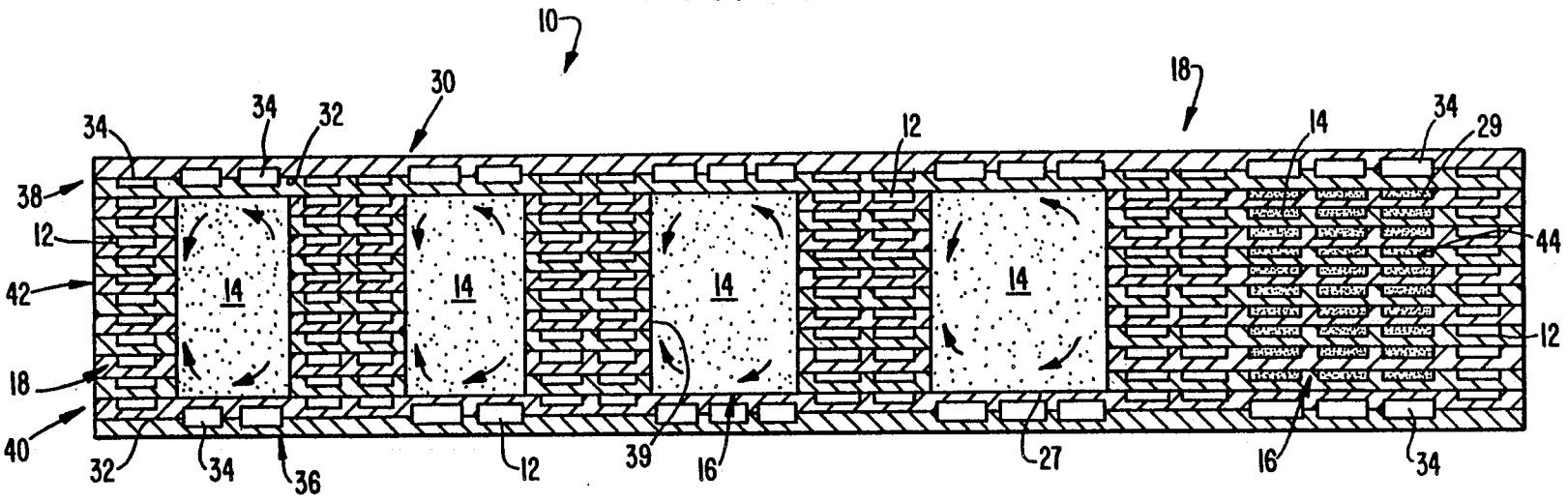
FIG. 2 illustrates a sectional view of FIG. 1.

FIG. 2 illustrates a sectional view of the heat exchanger core 10 of FIG. 1 illustrating the laminates which are used for fabricating the heat exchanger core. While the present invention is not limited to being fabricated from a plurality of laminates as described below, it should be understood that the utilization of laminates permits the economical fabrication of the heat exchanger core including high performance heat transfer structures having increased surface area and/or which form new boundary layers and/or increase turbulence that would be difficult to fabricate by conventional metal processing techniques. Like reference numerals identify like parts in FIGS. 1 and 2. The heat exchanger core 10 is fabricated by joining a plurality of laminates together by a fluid tight seal such as by brazing or use of adhesives. The laminates may be fabricated of a brazable aluminum alloy or of any suitable material which may be bonded together to prevent leakage between the heat source fluid 12 and the coolant 14. The top surface of the heat exchanger core 10 is defined by a top laminate 30. The top laminate 30 has an annulus identical to that illustrated in FIG. 1. A bottom surface 32 of the top laminate 30 contains a plurality of channels 34 which function to conduct the heated fluid 12 in a spiral having an innermost radial point with respect to the center of the heat exchanger at the left of FIG. 2 and an outermost radial point at the right of FIG. 2 with respect to the center of the heat exchanger. Preferably, while not limited thereto, the channels 34 are fabricated by photochemical etching of the metallic material from which the top laminate is fabricated. However, it should be understood that the present invention is not limited to any particular process for forming the channels. Bottom laminate 36 has a construction identical to the top laminate 30 and is formed in the same manner. A top intermediate laminate 38 is shaped similarly to the top laminate 30 except that the channels 34 have a slightly different configuration in that additional channels are provided radially inward and outward of each turn of the coolant channel 16. Bottom intermediate laminate 40 has a construction identical to the top intermediate laminate 38 and faces the bottom laminate 36.

Figure 3:
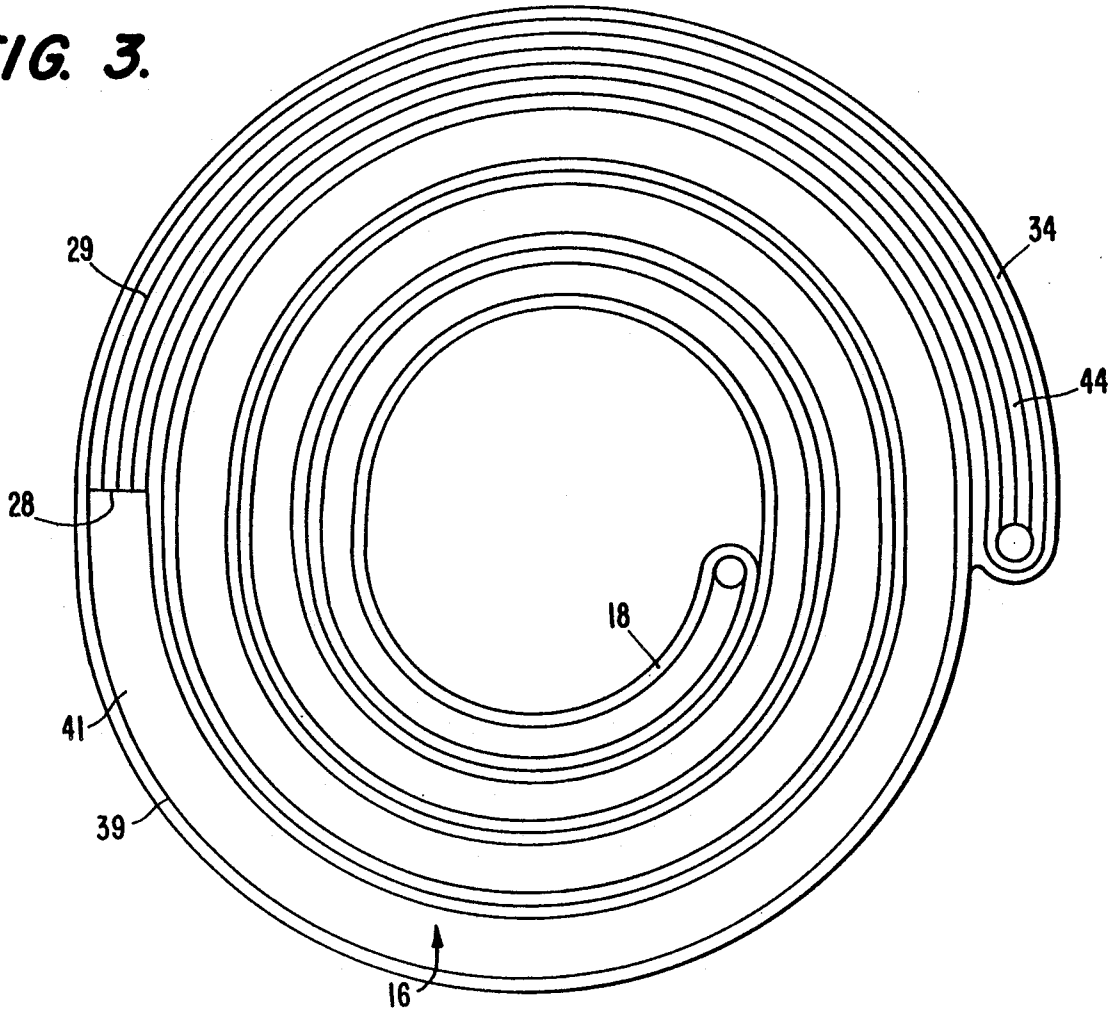
FIG. 3 illustrates a plan view of a single spiral laminate utilized in the fabrication of a first embodiment of a heat exchanger of the present invention.

A plurality of spiral laminates 42, as illustrated sectionally in FIG. 2 and individually in FIG. 3, are stacked together in vertical registration to align the channels 34 to form the heated fluid channel 18 and coolant channel 16. The coolant 14 in the first portion 27 of the coolant channel 16 flows along the coolant channel towards the outlet 24 and wets the walls 39 with liquid coolant. The centrifugal force applied to the coolant fluid 14 as it moves radially outward in the coolant channel 16 causes curvilinear fluid flow which produces the wet wall fluid flow as indicated by the arrows within the hollow rectangular cross section of the portion 27 of the coolant channel 16. A plurality of channels 34 are preferably provided within the turns of the spiral laminate 42 as illustrated in FIGS. 2 and 3. The channels 34 are preferably fabricated by photochemical etching in the same manner as the laminates 30, 36, 38 and 40. However, it should be understood that the present invention is not limited to any particular process for forming the channels 34. In the second portion 29 of the coolant channel 16 the plurality of channels 44 are formed within the outermost portion of the spiral laminate 42 in a same manner as channels 34. The purpose of the channels 44 is to provide increased surface area to enhance the rate of transfer of heat from the heat conductive core of the heat exchanger to the superheated coolant 14 within the second portion 29 of the coolant channel 16. By providing the channels 44 only in the area where the coolant 14 becomes superheated, it is possible to minimize the volume and weight which is of importance in airframes by having structures which increase the rate of heat transfer only where the heat carrying capacity of the coolant is lowered because of its gaseous phase in the heat exchanger core. As is apparent from FIG. 2, the cross sectional area of the respective turns of the coolant channel 16 increases as a function of radius of the coolant channel measured from the center of the heat exchanger. The increasing of cross-sectional area as a function of radius minimizes pressure drop across the length of coolant channel 16 to provide a high coefficient of performance when the heat exchanger 10 is used as an evaporator or condenser in a vapor cooling device. The sidewalls 39 of the first portion 27 of the coolant channel 18 are defined by the space extending through a thickness of the spiral laminate 42 between adjacent turns of the spiral laminate as illustrated in FIG. 3.

In applications where the heat source fluid has a freezing point above the coolant saturation temperature, the heated fluid 12 may be cooled sufficiently to cause ice to form in channel 18. A series of pockets 46 are contained in the sidewalls of the heated fluid channel 18 which project from at least one of the sidewalls toward an adjacent coolant channel 16. As a consequence of the pocket 46 being disposed closer to the lower temperature of the coolant channel 16, any ice layer formed in the heated fluid 12 will be firmly held in place by the pockets, thus preventing ice layer shedding in the main channel which could occlude fluid flow. The pockets 46 formed are preferably formed by photochemical etching in the same manner as the channels 34 are formed with the periphery of the pocket being defined by processing in the same manner as the edges of the channels 42.

Figure 4A:
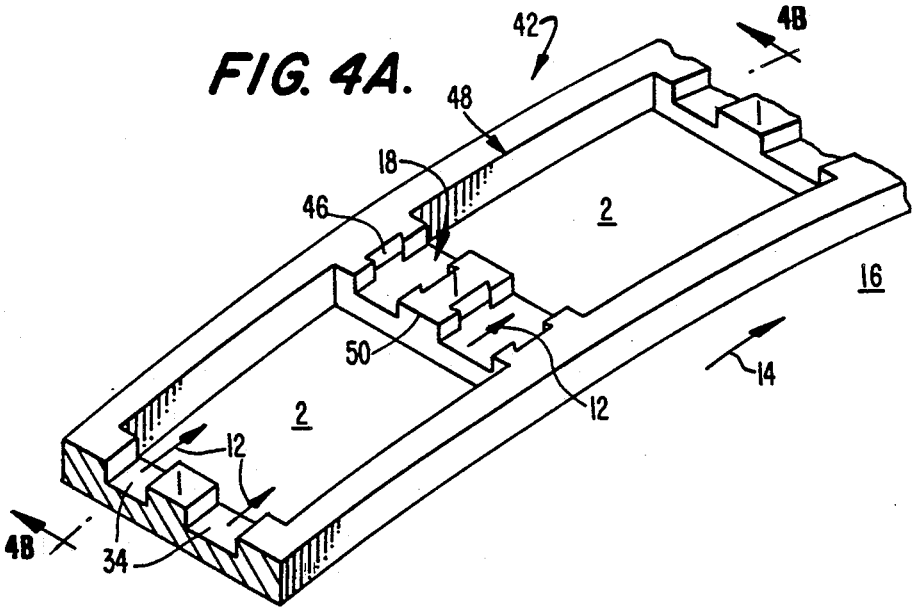
FIGS. 4A and 4B illustrate a structure which may be used in the channel carrying heated fluid and in the portion of the coolant channel carrying superheated fluid to enhance heat transfer.
Figure 4B:
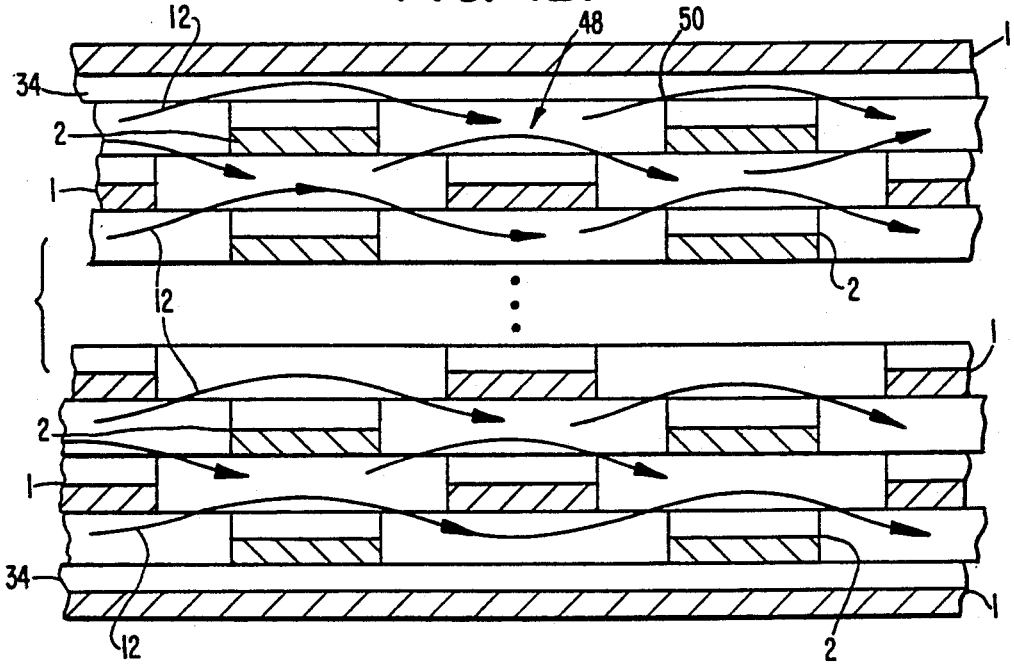

FIGS. 4A and 4B illustrate a structure having enhanced surface area which may be incorporated within the heat exchanger core to enhance heat transfer. Like reference numerals in FIGS. 1–4A–B identify like parts. The enhanced surface area structure functions to produce new boundary layers. The heated fluid 12 flowing in the heated fluid channel 18 encounters edges 50 which are on the periphery of the openings 48 which extend completely through the spiral laminate 42. The edges 50 form a new boundary layer to enhance heat exchange between the heated fluid 12 and the walls of the spiral laminate 42. The area identified by "1" is the heat conductive material from which the spiral laminates 42 are formed and separates adjacent openings 48 which are at spaced apart locations along the heated fluid channels 18 and the area identified by "2" is the heat conductive material of the next underlying laminate. As illustrated in section FIG. 4B, the heated fluid 12 produces new boundary layers at edges 50 and flows turbulently vertically between the different laminates which are respectively identified by "1" and "2". As a result, as the heated fluid 12 flows through channel 18 it flows upward and downward between different layers of spiral laminates and encounters multiple edges 50 which each produce a new boundary to enhance heat exchange. While the mechanism of FIGS. 4A and 4B for enhancing the rate of heat transfer between heated fluid 12 and the heat conductive surfaces of the heat exchanger core has been illustrated in the heated fluid channel 18, it should be understood that the same mechanism may also be used in the second portion 29 of the coolant channel 16 where the coolant 14 is superheated.

Figure 5A:
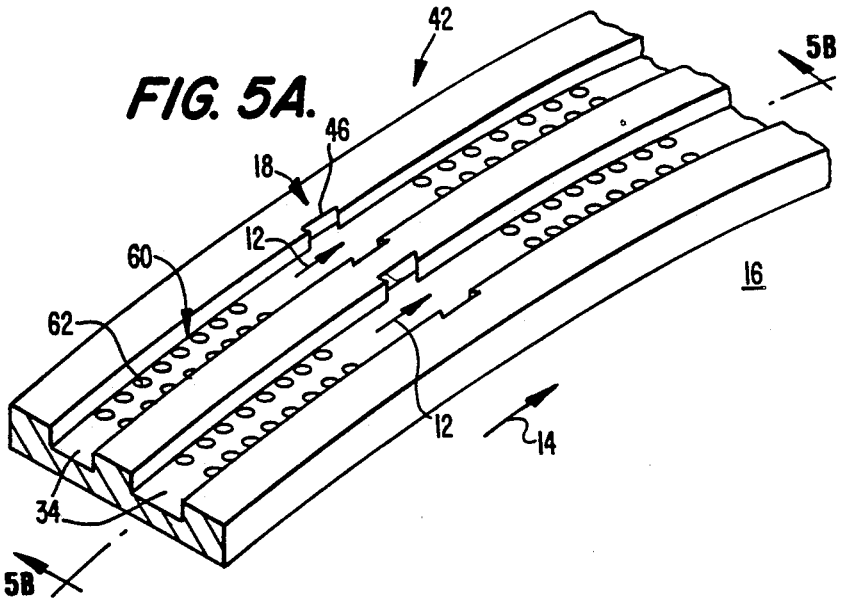
FIGS. 5A and 5B respectively illustrate heat transfer enhancement structures of adjacent laminates which may be used in the channel carrying the heated fluid and in the portion of the channel carrying superheated coolant.
Figure 5B:
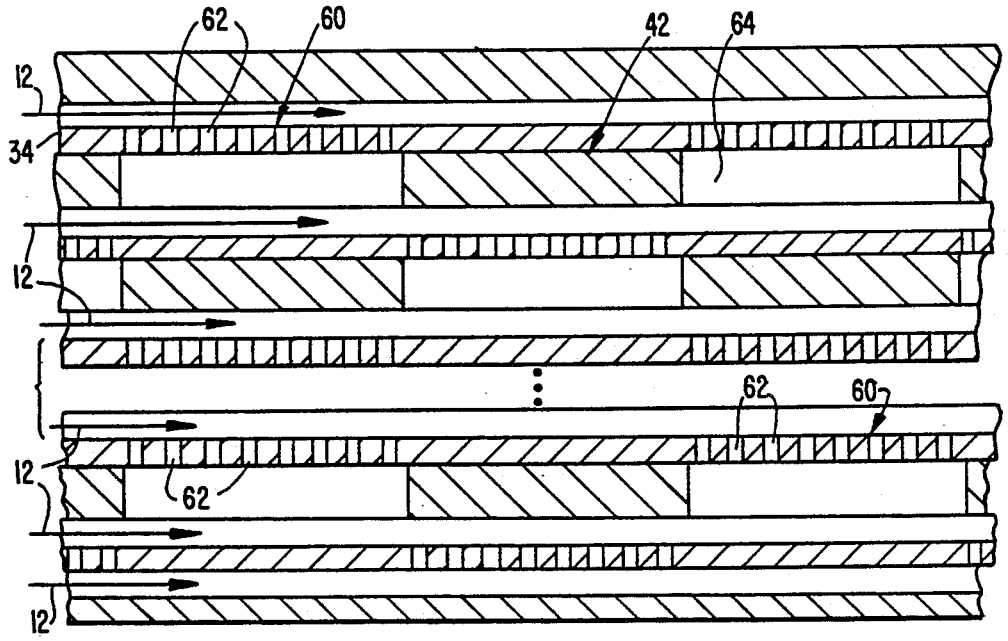

FIGS. 5A and 5B illustrate a second mechanism which may be incorporated in the heat exchanger core to enhance heat transfer. Like parts illustrate like parts in FIGS. 1-5A-B. In FIG. 5A a plurality of spaced apart arrays 60 each containing a plurality of apertures 62 are disposed along the heated fluid channels 34 of a spiral laminate 42. Each aperture 62 creates turbulence such as eddy currents as the heated fluid flows tangentially past the opening of the aperture to enhance the rate of heat transfer between the fluid 12 and the core of the heat exchanger. Directly below the spiral laminate of FIG. 5A is a second spiral laminate 42 which has a separate opening extending completely through the laminate which is registration with an array 60. Disposed below the second spiral laminate 42 of FIG. 5B is a spiral laminate 42 identical to FIG. 5A with the exception that the arrays 60 are staggered longitudinally along the channel 18 with respect to the arrays of FIG. 5A. While the mechanism of FIGS. 5A and 5B for enhancing the rate of heat transfer between the heated fluid 12 and the heat conductive surfaces of the heat exchanger core has been illustrated as being used in the heated fluid channel 18, it should be understood that it may also be used with equal facility in the second portion 29 of the coolant channel 12 where the coolant 14 is superheated.

Figure 6:
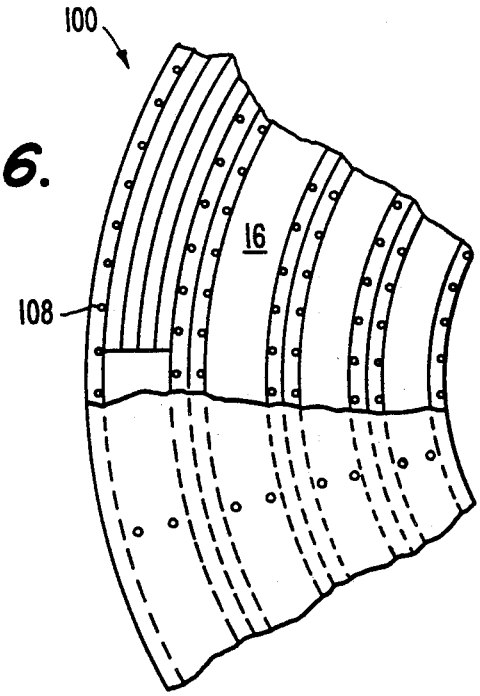
FIG. 6 illustrates a partial fragmentary top plan view of a spiral laminate in accordance with a second embodiment of the invention.
Figure 7:
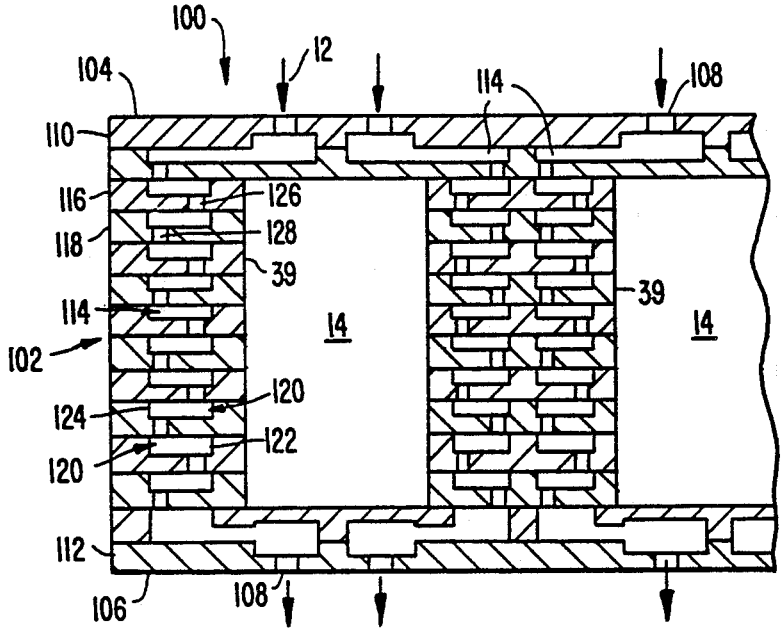
FIG. 7 illustrates a partial sectional view of FIG. 6.
Figure 8:
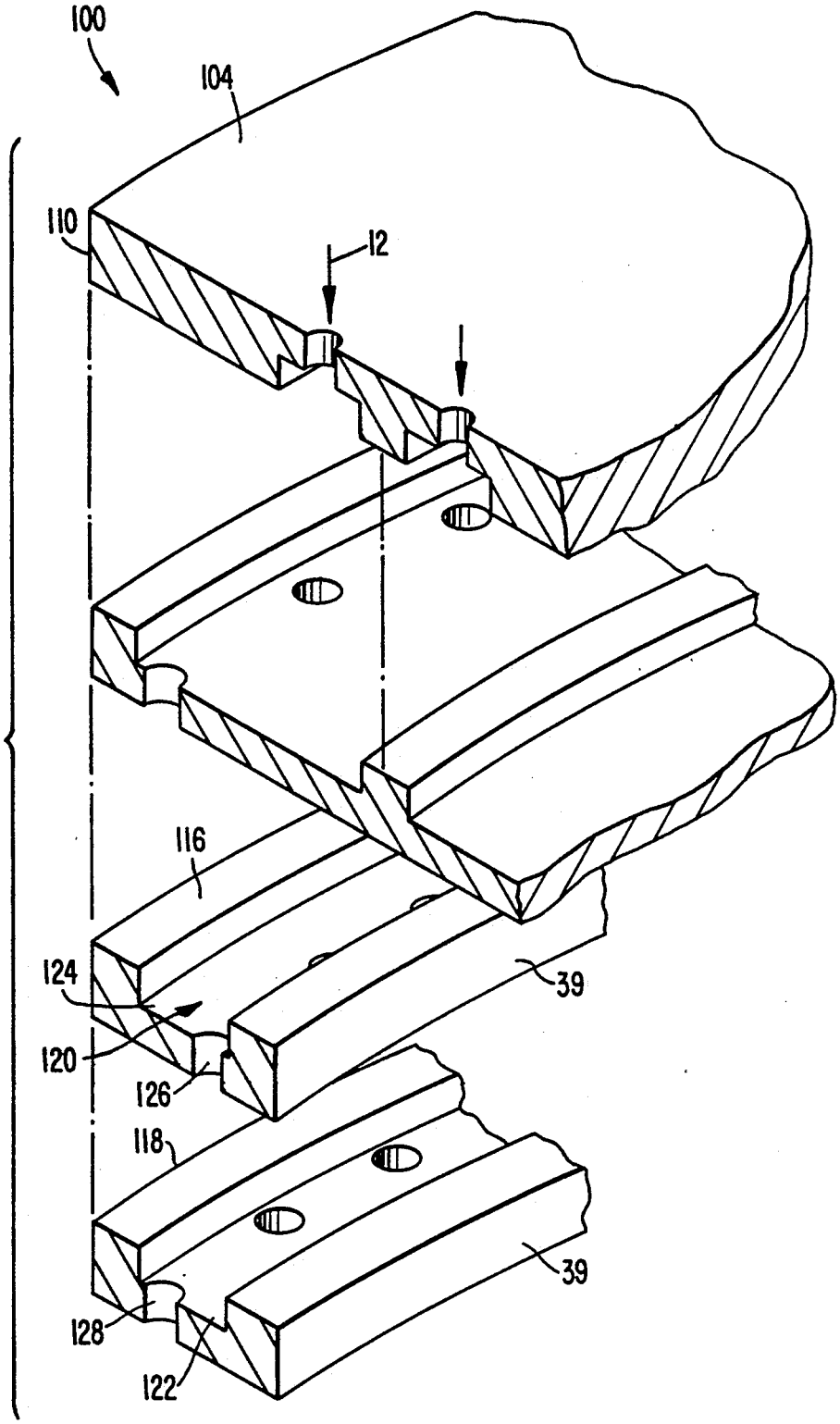
FIG. 8 illustrates an enlarged exploded perspective view of a portion of FIG. 7.

FIGS. 6-8 illustrate a second embodiment 110 of the present invention having a first coolant channel 16 identical to that illustrated in the first embodiment and a second channel 102, preferably orthogonal to the plane of the top and bottom surfaces 104 and 106, respectively, of the spiral heat exchanger having a heated fluid 12 flowing generally orthogonal to the direction of the coolant 14 in the coolant channel through apertures 108 respectively disposed in the top and bottom laminates 110 and 112. It should be understood that like reference numerals identify like parts in FIGS. 1-8 of the drawings. The direction of fluid flow in the second embodiment differs from the first embodiment in that the coolant 14 flowing in the coolant channel 16 is flowing spirally outward or inward and the heated fluid is flowing orthogonal to the direction of flow of the coolant and preferably orthogonal to the top and bottom laminates 110 and 122. A plurality of connecting heat conductive channels 114 are coupled to apertures 108 in the top and bottom laminates. Preferably, at least one connecting heat conductive channel 114 is disposed adjacent to each opening defined by opposed surfaces 39 between adjacent turns of a plurality of spiral laminates.

To enhance the rate of heat transfer between the heated fluid 12 and the heat exchanger core, a impingement heat exchange mechanism is contained in the connecting heat conductive channels 114. The core of the heat exchanger is built up with a plurality of alternating first and second spiral laminates 116 and 118 which are contained in the heat exchanger in vertical registration to form at least one spiral channel 16, each of the first spiral laminates 116 and each of the second spiral laminates 118 containing a cut out channel section 120 having a first end 122 and a second end 124 which extend radially with respect to the center of the heat exchanger. The first end 122 of each cut out channel section 120 of the first spiral laminate 116 has an aperture 126 extending through the cut out channel section to an opposed side of the first spiral laminate and the second end 124 of each cut out channel section of the second spiral laminate has an aperture 128 extending through the cut out channel section to an opposed side of the second spiral laminate. The opposed side of the apertures 126 of the first spiral laminates 116 each has an opening into an underlying cut out channel section 120 of one of the second spiral laminates 118 and the opposed side of the apertures 128 of the second spiral laminates each has an opening into an underlying cut out channel section of one of the first spiral laminates. By providing the series of cut out channel sections 120 interconnected with apertures, fluid flows along each cut out channel section to an aperture and flows through the aperture to form a jet of fluid which intersects the cut out channel section of the underlying laminate and flows to the other end of the cut out channel section into another aperture to form another jet of fluid which intersects an underlying cut out channel section of another laminate and so forth. This structure provides increased surface area which is impinged with fluid jets which enhances the rate of heat transfer in accordance with jet impingement cooling principles.

It should furthermore be understood that other known structures for enhancing the rate of heat transfer may be disposed in the second portion 29 of the coolant channel 16 and in the heated fluid channel 18.

While the invention has been described in terms of its preferred embodiment, it should be understood that numerous modifications may be made thereto without departing from the spirit and scope of the invention as defined in the appended claims. It is intended that all such modifications fall within the scope of the appended claims.

I claim:

1. A laminated spiral heat exchanger comprising:
a heat conductive top laminate;
a heat conductive bottom laminate;
at least one spiral heat conductive laminate, the laminates being joined together to form a heat exchanger core;
at least one spiral laminate with at least a portion of a first spiral channel being defined by a space extending through a thickness of the spiral laminate between adjacent turns of at least one spiral laminate and the top laminate and the bottom laminate;
a first fluid port coupled to the first spiral channel at a first radius with respect to a center point of the spiral heat exchanger;
a second fluid port coupled to the first spiral channel at a second radius with respect to the center point of the spiral heat exchanger which is greater than the first radius; and
wherein the laminates are planar and stacked parallel to each other.

2. A laminated spiral heat exchanger in accordance with claim 1 further comprising:

a second spiral channel spaced from the first spiral channel defined by a plurality of laminates, the second spiral channel having a third fluid port located at a third radius with respect to the center point of the spiral heat exchanger and a fourth fluid port located at a fourth radius with respect to the center point of the heat exchanger with the fourth radius being greater than the third radius; and wherein the space between adjacent turns varies as a function of a radius of the first channel measured from the center point.

3. A laminated spiral heat exchanger in accordance with claim 2 wherein:

the first fluid is a coolant and is coupled to the first channel from a first fluid source at the first port with the first fluid flowing through the first channel to the second port;

the second fluid is a heated fluid and is coupled to the second channel from a second fluid source at the third port with the second fluid flowing through the second channel to the fourth port; and the first channel has a cross-sectional area which increases as a function of increasing radius of the first channel with respect to the center point of the spiral heat exchanger along at least a first portion of the first channel extending from the first port and providing liquid contact with walls of the first channel as long as the first fluid is in a liquid phase.

4. A laminated spiral heat exchanger in accordance with claim 3 wherein:

the coolant flow through the first channel in a first portion of the first channel is at least partially in a liquid phase and the first fluid flow in the second portion of the first channel is superheated, the first portion of the first channel has a first heat exchange surface area per unit length and the second portion of the first channel has a second heat exchange surface area per unit length which is greater than the first heat exchange surface area.

5. A laminated spiral heat exchanger in accordance with claim 4 wherein:

the first channel is part of a vapor cycle cooling device.

6. A laminated spiral heat exchanger in accordance with claim 5 wherein:

the first portion of the first channel is defined by the space between adjacent turns of at least one spiral laminate and the top and bottom laminates; and the second spiral channel is comprised of at least one cutout channel extending into a surface of at least one spiral laminate and extending from the third port to the fourth port.

7. A laminated spiral heat exchanger in accordance with claim 6 wherein:

the second spiral channel is comprised of at least one first cutout channel in each of a plurality of spiral laminates, each cutout channel extending into a surface of a spiral laminate parallel to the top and bottom laminates on a pair of opposed sides of the first spiral channel and extending from the third port to the fourth port.

8. A laminated spiral heat exchanger in accordance with claim 7 wherein:

the second channel contains means for diverting the second fluid between different spiral laminates as the second fluid flows through the second channel.

9. A laminated spiral heat exchanger in accordance with claim 8 wherein:

the means for diverting comprises each spiral laminate containing spaced apart holes extending through the spiral laminate with each hole having an opening within the first cutout channel; and the plurality of spiral laminates are in registration with the first cutout channel of each spiral laminate being at least partially in registration with at least one adjacent first cutout channel of an adjacent spiral laminate and the holes of adjacent spiral laminates are offset so that the second fluid does not flow orthogonally with respect to the top and bottom laminates through first cutout channels of adjacent spiral laminates.

10. A laminated spiral heat exchanger in accordance with claim 9 wherein:

the holes are disposed in a single row along the first cutout channel with adjacent holes being separated by a solid portion spanning the first cutout channel in a direction along fluid flow in the second channel.

11. A laminated spiral heat exchanger in accordance with claim 9 wherein:

the holes are disposed in a plurality of arrays disposed at spaced apart locations along fluid flow in the second channel with each array being separated by a solid portion spanning the first cutout channel in a direction along fluid flow in the second channel.

12. A laminated spiral heat exchanger in accordance with claim 10 wherein:

the second portion of the first channel contains means for permitting the first fluid between different spiral laminates as the first fluid flows through the second portion of the first channel.

13. A laminated heat exchanger in accordance with claim 12 wherein:

the second portion of the first channel is defined by a second cutout channel extending partially within a plurality of spiral laminates parallel to the top and bottom laminates and extending along the second portion to the second port;

each spiral laminate contains a series of holes extending through the spiral laminate with each hole having an opening within the second cutout channel in the second portion of the first channel; and the second cutout channel of each spiral laminate is in at least partial registration with at least one adjacent second cutout channel of an adjacent spiral laminate and the holes of adjacent spiral laminates are offset so that the fluid does not flow orthogonally with respect to the top and bottom laminates through cutout channels of adjacent spiral laminates.

14. A laminated spiral heat exchanger in accordance with claim 13 wherein:

holes are disposed in a single row along the second cutout channel with adjacent holes being separated by a solid portion spanning the second cutout channel in a direction along fluid flow in the first channel.

15. A laminated spiral heat exchanger in accordance with claim 13 wherein:

the holes are disposed in a plurality of arrays disposed at spaced apart locations along fluid flow in the first channel.

16. A laminated spiral heat exchanger in accordance with claim 7 wherein:

the second channel includes means for preventing ice formation within the second channel to prevent occlusion of the second channel to the flow of the heated fluid therein.

17. A laminated spiral heat exchanger in accordance with claim 16 wherein the means for preventing ice formation comprises:

a series of pockets contained in side walls of the second channel which project from at least one of the side walls toward an adjacent first channel.

18. A laminated spiral heat exchanger in accordance with claim 9 wherein:

the second channel includes means for preventing ice formation within the second channel to prevent occlusion of the second channel to the flow of the heated fluid therein.

19. A laminated spiral heat exchanger in accordance with claim 18 wherein:

a series of pockets are contained in side walls of the second channel which project from at least one of the side walls toward an adjacent first channel.

20. A laminated spiral heat exchanger in accordance with claim 13 wherein:

the second channel includes means for preventing ice formation within the second channel to prevent occlusion of the second channel to the flow of the heated fluid therein.

21. A laminated spiral heat exchanger in accordance with claim 20 wherein the means for preventing ice formation comprises:

a series of pockets contained in side walls of the second channel which project from at least one of the side walls toward an adjacent first channel.

22. A spiral heat exchanger comprising:

a heat exchanger core containing first and second spaced apart spiral channels within the core, the first spiral channel having a coolant inlet port located at a first radius with respect to a center point of the heat exchanger and a coolant outlet port located at a second radius with respect to the center point of the heat exchanger with the second radius being greater than the first radius, the second spiral channel having a heated fluid inlet port located at a third radius with respect to a center point of the heat exchanger core and a heated fluid outlet port located at a fourth radius with respect to the center point of the heat exchanger core with the fourth radius being greater than the third radius, a source of pressurized coolant fluid coupled to the coolant inlet port and a condenser coupled to the coolant outlet port, and heat flows from the heated fluid to the heat exchanger core to the coolant; and wherein the first spiral channel has an increasing cross-sectional area from the coolant inlet port toward the coolant outlet port as a function of a radius of the first spiral channel extending from the center point of the heat exchanger to the first spiral channel; and the coolant in a liquid phase wets side walls of the first channel during flow of the coolant from the coolant inlet port toward the coolant outlet port.

23. A spiral heat exchanger in accordance with claim 22 wherein:

the first spiral channel has a first portion extending from the coolant inlet port toward the coolant outlet port to a point where the coolant becomes superheated and a second portion extending from the point where the coolant becomes superheated to the coolant outlet port.

24. A spiral heat exchanger in accordance with claim 23 wherein:

the second portion of the first channel and the second channel contain a plurality of heat conductive surfaces disposed within an interior of the channels and in thermal contact with the heat exchanger core to enhance transfer of heat between the heated fluid and the coolant by causing the coolant in the second portion of the first spiral channel to flow transversely with respect to a spiral axis of the first channel and the heated fluid to flow transversely with respect to a spiral axis of the second spiral channel.

25. A spiral heat exchanger in accordance with claim 23 wherein:

the second portion of the first channel has means for causing transverse coolant fluid flow with respect to a spiral axis of the first channel; and the first channel contains means for causing transverse heated fluid flow with respect to a spiral axis of the second channel.

26. A spiral heat exchanger in accordance with claim 25 further comprising:

means, disposed within the second channel, for preventing ice formation within the second channel to prevent occlusion of the second channel to the flow of the heated fluid therein.

27. A spiral heat exchanger in accordance with claim 26 wherein the means for preventing ice formation comprises:

a series of pockets contained in side walls of the second channel which project from at least one of the side walls toward an adjacent first channel.

28. A spiral heat exchanger comprising:

a heat exchanger core containing first and second spaced apart spiral channels within the core, the first spiral channel having a coolant inlet port located at a first radius with respect to a center point of the heat exchanger and a coolant outlet port located at a second radius with respect to the center point of the heat exchanger with the second radius being greater than the first radius, the second spiral channel having a heated fluid outlet port located at a third radius with respect to a center point of the heat exchanger core and a heated fluid inlet port located at a fourth radius with respect to the center point of the heat exchanger core with the fourth radius being greater than the third radius, a source of pressurized coolant fluid coupled to the coolant inlet port and a condenser coupled to the coolant outlet port, and heat flows from the heated fluid to the heat exchanger core to the coolant; and wherein the first spiral channel has an increasing cross-sectional area from the coolant inlet port toward the coolant outlet port as a function of a radius of the first spiral channel extending from the center point of the heat exchanger to the first spiral channel; and the coolant in a liquid phase wets side walls of the first channel during flow of the coolant from the coolant inlet port toward the coolant outlet port.

29. A spiral heat exchanger in accordance with claim 28 wherein:

the first spiral channel has a first portion extending from the coolant inlet port toward the coolant outlet port to a point where the coolant becomes superheated and a second portion extending from the point where the coolant becomes superheated to the coolant outlet port.

30. A spiral heat exchanger in accordance with claim 29 wherein:

the second portion of the first channel and the second channel contain a plurality of heat conductive surfaces disposed within an interior of the channels and in thermal contact with the heat exchanger core to enhance transfer of heat between the heated fluid and the coolant by causing the coolant in the second portion of the first spiral channel to flow transversely with respect to a spiral axis of the first channel and the heated fluid to flow transversely with respect to a spiral axis of the second spiral channel.

31. A spiral heat exchanger in accordance with claim 29 wherein:

the second portion of the first channel has means for causing transverse coolant fluid flow with respect to a spiral axis of the first channel; and the first channel contains means for causing transverse heated fluid flow with respect to a spiral axis of the second channel.

32. A spiral heat exchanger in accordance with claim 31 further comprising:

means, disposed within the second channel, for preventing ice formation within the second channel to prevent occlusion of the second channel to the flow of the heated fluid therein.

33. A spiral heat exchanger in accordance with claim 32 wherein the means for preventing ice formation comprises:

a series of pockets contained in side walls of the second channel which project from at least one of the side walls toward an adjacent first channel.

34. A laminated spiral heat exchanger comprising:

a heat conductive top laminate;

a heat conductive bottom laminate;

a plurality of spiral heat conductive laminates, the laminates being joined together to form a heat exchanger core;

a spiral channel disposed between turns of at least one spiral laminate;

a first fluid port coupled to each spiral channel at a first radius with respect to a center of the spiral heat exchanger;

a second fluid port coupled to each spiral channel at a second radius with respect to the center point of the spiral heat exchanger which is greater than the first radius; and a plurality of connecting heat conductive channels disposed between the top laminate and the bottom laminate for connecting apertures in the top and bottom laminates, a plurality of the heat conductive connecting channels each containing a jet impingement cooling means therein for forming at least one jet when a fluid flows between the top and bottom laminates which intersects a heat conductive surface within the connecting channel to provide enhanced heat exchange between the connecting channel and the fluid.

35. A laminated spiral heat exchanger in accordance with claim 34 wherein:

a plurality of alternating first and second spiral laminates are contained in the heat exchanger to form the spiral channel, each of the first spiral laminates and each of the second spiral laminates containing a cut out channel section having first and second ends and which extends radially with respect to the center of spiral heat exchanger, the first end of the cut out channel section of the first spiral laminate having an aperture extending through the cut out channel section to an opposed side of the first spiral laminate and the second end of the cut out channel section of the second spiral laminate having an aperture extending through the cut out channel section to an opposed side of the second spiral laminate, the opposed side of the apertures of the first spiral laminates each opening into an underlying cut out channel section of one of the second spiral laminates and the opposed side of the apertures of the second spiral laminates each opening into an underlying cut out channel section of one of the first spiral laminates.

36. A laminated spiral heat exchanger in accordance with claim 35 wherein:

a connecting heat conductive channel is disposed adjacent to each opening between adjacent turns of a plurality of spiral laminates.

37. A laminated spiral heat exchanger in accordance with claim 36 wherein:

the first fluid is a coolant; and the second fluid is a heated fluid.

38. A laminated spiral heat exchanger in accordance with claim 37 wherein:

the second fluid is air.

39. A laminated spiral heat exchanger in accordance with claim 2 wherein:

the space increases from the first fluid port toward the second fluid port as a function of the radius.

40. A laminated heat exchanger in accordance with claim 2 wherein:

a cross-sectional area of the first channel varies in proportion to the space.

41. A laminated heat exchanger in accordance with claim 39 wherein:

a cross-sectional area of the first channel varies in proportion to the space.

* * * * *